US009865954B2

(12) United States Patent
Zebhauser

(10) Patent No.: US 9,865,954 B2
(45) Date of Patent: Jan. 9, 2018

(54) PLUG CONNECTION

(71) Applicant: ROSENBERGER HOCHFREQUENZTECHNIK GMBH & CO. KG, Fridolfing (DE)

(72) Inventor: Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/119,462

(22) PCT Filed: Jan. 8, 2015

(86) PCT No.: PCT/EP2015/000021

§ 371 (c)(1),
(2) Date: Aug. 17, 2016

(87) PCT Pub. No.: WO2015/124245

PCT Pub. Date: Aug. 27, 2015

(65) Prior Publication Data

US 2017/0012380 A1 Jan. 12, 2017

(30) Foreign Application Priority Data

Feb. 20, 2014 (DE) ..... 20 2014 001 590 U

(51) Int. Cl.
*H01R 13/187* (2006.01)
*H01R 13/53* (2006.01)
*H01R 13/24* (2006.01)

(52) U.S. Cl.
CPC ..... *H01R 13/187* (2013.01); *H01R 13/2421* (2013.01); *H01R 13/2464* (2013.01); *H01R 13/53* (2013.01)

(58) Field of Classification Search
CPC ..... H01R 13/22; H01R 13/53; H01R 13/187; H01R 13/2421; H01R 13/2464
USPC ..... 439/675, 289, 824
See application file for complete search history.

(56) References Cited

U.S. PATENT DOCUMENTS

| | | | |
|---|---|---|---|
| 5,425,649 | A | 6/1995 | Reymond |
| 5,509,813 | A | 4/1996 | Lu |
| 6,517,359 | B1 | 2/2003 | Felps |
| 2008/0064270 | A1 | 3/2008 | Dhshima |

FOREIGN PATENT DOCUMENTS

| | | | |
|---|---|---|---|
| DE | 1092533 | B | 11/1960 |
| DE | 4441303 | A1 | 1/1996 |
| DE | 20002684 | U1 | 5/2000 |

(Continued)

OTHER PUBLICATIONS

Machine Translation of DE 1092533, Nov. 10, 1960.*

*Primary Examiner* — Tulsidas C Patel
*Assistant Examiner* — Travis Chambers
(74) *Attorney, Agent, or Firm* — DeLio, Peterson & Curcio, LLC; Robert Curcio

(57) ABSTRACT

A plug connection having a first plug with a first contact piece and a second plug with a second contact piece. In the plugged state of the plug connection, the contact pieces are axially in contact with one another in a spring-biased manner. The first contact piece has a three-dimensionally curved end face, while the second contact piece has a flaring depression in the end face thereof such that an annular contact zone is formed between the contact pieces.

7 Claims, 4 Drawing Sheets

(56) References Cited

FOREIGN PATENT DOCUMENTS

| | | | |
|---|---|---|---|
| DE | 202011107900 | U1 | 11/2011 |
| EP | 0836245 | A2 | 4/1998 |
| EP | 2683038 | A1 | 1/2014 |

* cited by examiner

PLUG CONNECTION

BACKGROUND OF THE INVENTION

1. Field of the Invention

The invention relates to a plug connection and in particular a plug connection for connecting high-current cables, as used for example in or for motor vehicles with electric drives.

2. Description of Related Art

Particular requirements apply to plug connections which are used for the connection of high-current cables in, for example, motor vehicles. These are, among other things, relevant to the safety of the assembly personnel plugging together or disconnecting the plug connector as well as for the protection of the electronic components built into the motor vehicle. For example, in addition to the contact parts provided for the transmission of the high currents, which are generally dimensioned with a large cross-section, it is known for additional contact elements to be integrated in the plug connector which are electrically isolated from the contact parts and are part of a safety circuit carrying low voltage (in particular 12 V, 24 V or 48 V of the on-board electrical system of the motor vehicle). By means of the safety circuit it is ensured that the high voltage is only applied to the contact parts of the plug connector when these make full contact. For this purpose, the safety circuit is integrated in a control system for the high voltage source, wherein the control system only activates the high voltage source if the safety circuit is closed as a result of the contact elements of the plug connection making contact. For this purpose, the plug connectors are designed such that, on plugging together the plug connector, the contact parts connected with the high-current cables are connected first, and only then the contact elements for the safety circuit. On disconnecting such a connection, the contact elements of the safety circuit are disconnected first, as a result of which—if this has not already happened—a supply of high voltage to the high-current cables is interrupted. Only then are the contact parts connected with the high-current cables disconnected. This prevents a sparkover on plugging together or disconnecting the plug connection as a result of high voltage being present, which could lead to injury to the assembly personnel and to a burning of the contact parts. Such safety functionality is often referred to by the term "interlock".

A plug connection of this kind is for example known from DE 20 2011 107 900 U1. Here, the contact parts are designed as simple contact pins and contact sockets, which plug into one other when the plug connectors are plugged together.

Such a design of the contact elements of the safety circuit requires that the plug connectors be plugged together in an exact alignment relative to one other, which makes handling more difficult.

SUMMARY OF THE INVENTION

Starting out from this prior art, the invention was based on the problem of improving a plug connection intended in particular for high voltage applications in or for motor vehicles. In particular, the plug connection should be simple to handle when plugging together, and should be distinguished by secure contacting and/or low manufacturing costs.

The above and other objects, which will be apparent to those skilled in the art, are achieved in the present invention which is directed to a plug connection comprising a first plug connector with a first contact part and a second plug connector with a second contact part, wherein, in the plugged-together state of the plug connection, the contact parts make contact with one another axially in a spring-biased manner, such that the first contact part has a three-dimensionally-curved end face and the second contact part has a depression in its end face which widens in a trumpet-like form in the direction of the plug-side end of the second contact part, so that an annular contact region between the contact parts is created.

The end face of the first contact part may be partially spherical. The depression of the second contact part may be conical in form.

The plug connection may include a first housing accommodating the first contact part and/or a second housing accommodating the second contact part, wherein at least one of the contact parts is mounted in the associated housing such that it can be displaced axially in a spring-biased manner.

The plug connection may include a helical spring surrounding the axially displaceable spring-biased contact part which is supported between a section of the contact part and a section of the housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
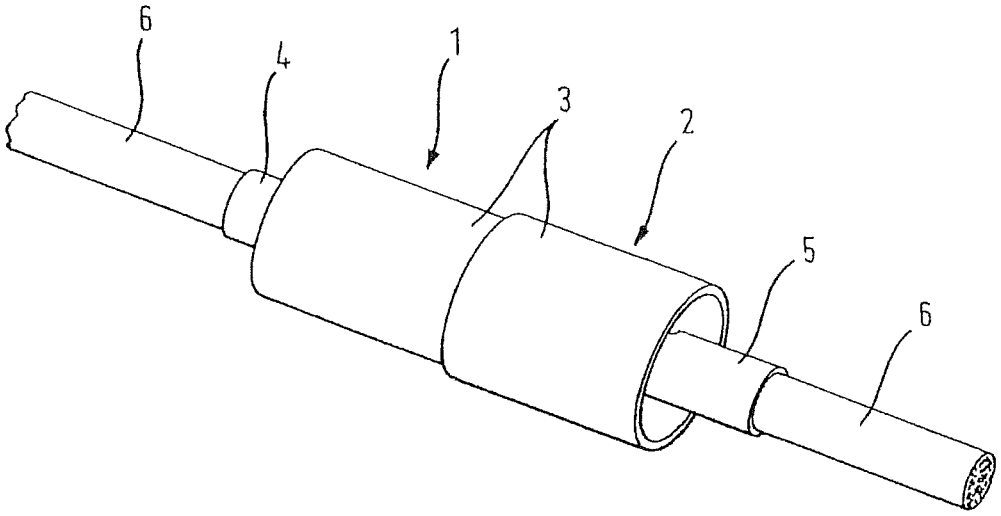
FIG. 1 shows a perspective view of a first embodiment of a plug connection according to the invention.
Figure 2:
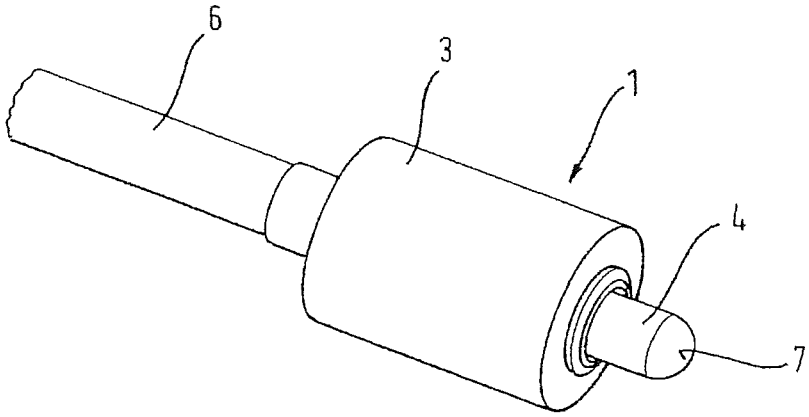
FIG. 2 shows a perspective view of first plug connector of the plug connection according to FIG. 1.
Figure 3:
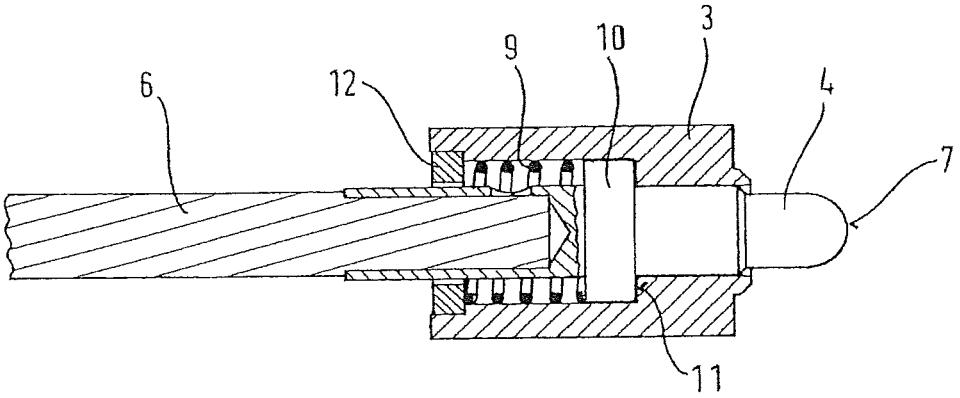
FIG. 3 shows the plug connector according to FIG. 2 in a longitudinal section.

In describing the preferred embodiment of the present invention, reference will be made herein to FIGS. 1-8 of the drawings in which like numerals refer to like features of the invention.

The problem delineated above is solved through a plug connection according to the claims. Advantageous embodiments thereof are the subject matter of the dependent claims and are explained in the following description of the invention.

According to the invention, a plug connection comprising (at least) one first plug connector with (at least) one first contact part and a second plug connector with (at least) one second contact part, wherein, in the plugged-together state of the plug connection, the associated first and second contact parts make contact with one another axially in a spring-biased manner, is characterized in that the first contact part has, at least in the section in which this makes contact with the second contact part, a three-dimensionally-curved end face, and the second contact part has, at least in the section in which this makes contact with the first contact part, a (in the direction of the associated end of the contact part) conically widening depression in its end face, so that an annular contact region between the contact parts is created.

"Conically" is understood here to mean a surface of revolution which is formed by a curve rotating around an axis. The conical depression can thereby preferably be trumpet-formed, i.e., with a curve or surface which is curved in the direction of the axis. Other forms for the conical depression, for example conical or partially conical or vase-formed (i.e., with a curvature of the curve or surface pointing away from the axis) are also possible. More complex forms for the curve or surface are also possible, but may be associated with higher manufacturing costs.

Numerous advantages can be achieved as a result of the design of the plug connection according to the invention. On the one hand, the special design of the end faces of the first and second contact parts ensure a self-centering of the contact parts in relation to their longitudinal axes.

In order to support this, in a preferred design it can be the case that the first and/or second contact part can move radially, at least in the region of the end face serving as a contact surface, which can for example be realized through a corresponding mounting in a housing of the associated plug connector. This radial freedom of movement can also be achieved through a pivoting around an axis perpendicular to the longitudinal axis of the corresponding contact part. Due to the special design of the contacting end faces, the possibility that, in consequence, the longitudinal axes of the two contact parts making contact may not be coaxial or parallel does not represent a problem which is relevant in terms of the security of the contact. A further advantage of the plug connection according to the invention can result from the fact that no delicate components are provided in the contact region. From a viewpoint of component protection, it may therefore be possible to dispense with an interlock safety circuit and design the plug connection, for the preferred high current applications, as a so-called hot-plug capable connection.

In a preferred design of the plug connection according to the invention, it can be the case that the end face of the first contact part is partially spherical. Such a design of the end face of the first contact part, in particular in combination with an also preferred trumpet-formed design of the depression of the second contact part, can be distinguished by a good self-centering functionality as well as by particularly good insensitivity to the longitudinal axes of the contact parts not being coaxial or parallel.

Preferably, it can be the case that each of the plug connectors has a housing accommodating the associated contact part. Preferably, it can then also be the case that at least one of the contact parts is mounted in the associated housing such that it can be displaced axially in a spring-biased manner. This can represent a structurally simple realization of the axial spring-loading of the contact region formed between the contact parts.

In this case the spring-loading of the contact region can preferably be realized by means of a helical spring surrounding the axially displaceable contact part which is supported between a section, for example a flange running around the outside of the contact part and a section, for example a flange running around the inside of the housing. A component which is cheaply available as a bought-in part can thus be used for the spring bias, wherein the arrangement of the helical springs surrounding the contact part also takes up little space.

Figure 4:
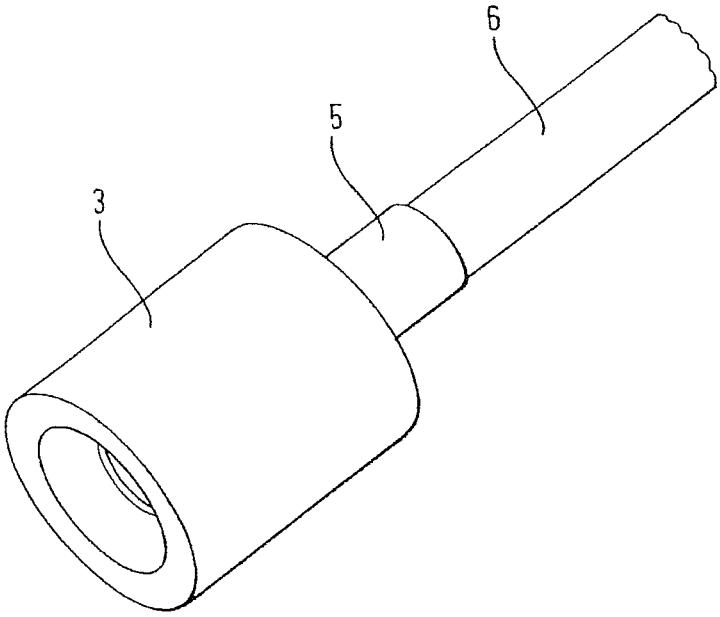
FIG. 4 shows a perspective view of the second plug connector of the plug connection according to FIG. 1.
Figure 5:
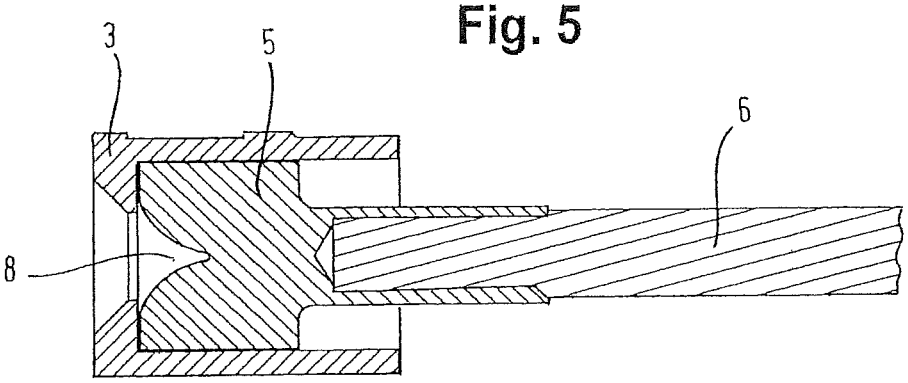
FIG. 5 shows the plug connector according to FIG. 4 in a longitudinal section.

The connection shown in FIG. 1 comprises a first plug connector 1 (see FIGS. 2 and 3) and a second plug connector 2 (see FIGS. 4 and 5). Both plug connectors 1, 2 each comprise a housing 3 as well as a contact part 4, 5 arranged at least partially within the respective housing. Both contact parts 4, 5 have a plug-side end which is intended to make axial contact with the other contact part 4, 5. Both contact parts 4, 5 also have a cable-side end which is intended for connection with a conductor 6 of a cable which is otherwise not represented. For this purpose, the cable-side ends of the contact parts 4, 5 are tubular in form, so that they can receive the end of the conductor 6 of the associated cable. A mechanical connection between the contact parts 4, 5 and the conductors 6 can for example be created through soldering, for which purpose soldering openings are provided in the contact parts 4, 5.

The contact part 4 of the first plug connector 1 has at its plug-side end a partially spherical end face 7. This makes contact with an end face of the contact part 5 of the second plug connector 2 in a depression 8, which is designed so as to widen (in the direction of the plug-side end) in a trumpet-like form. This creates an annular contact region between the contact parts 4, 5, which also exists if the two plug connectors 1, 2 or the two contact parts 4, 5 are not aligned exactly coaxially with one another (in relation to the longitudinal axes of the circular-cross-section contact parts 4, 5). As a result, in terms of reliability of contact, the plug connection is relatively insensitive to tolerances of position and form of the components.

In order to guarantee the axial contact pressure also necessary for reliability of contact, the contact part 4 of the first plug connector 1 is mounted within the associated housing 3 such that it can move axially (i.e. in the directions defined by the longitudinal axis) and is biased, by means of a pre-tensioned helical spring 9, in the direction of the second plug connector 2. The axial freedom of movement of the contact part 4 within the housing 3 is limited by an annular flange 10 running around the outside of the contact part 4 coming to rest against a shoulder 11 formed by a sudden change in diameter of a receiving opening formed centrally within the housing 3. The helical spring is supported between the peripheral flange 10 of the contact part 4 and a fixing sleeve 12 which is pressed into the receiving opening of the housing 3 from the cable-side end during the assembly of the first plug connector 1, thus guaranteeing the cohesion of the first plug connector 1.

In order to assemble the second plug connector 2, its contact part 5 is also fitted from the cable-side end into a centrally arranged receiving opening of the associated housing 3 and fixed in place there (e.g. in a force-locking manner through pressing or through adhesive bonding).

Figure 6:
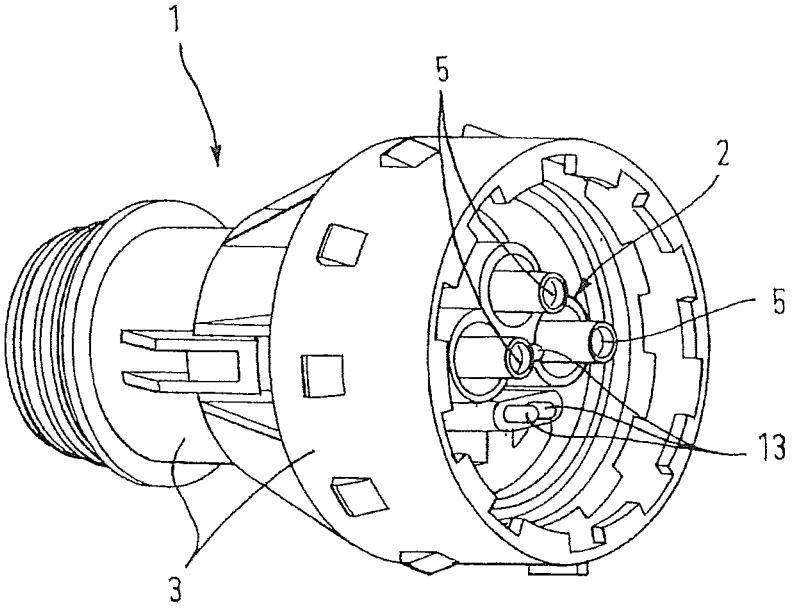
FIG. 6 shows a perspective view of a second embodiment of a plug connection according to the invention.
Figure 7:
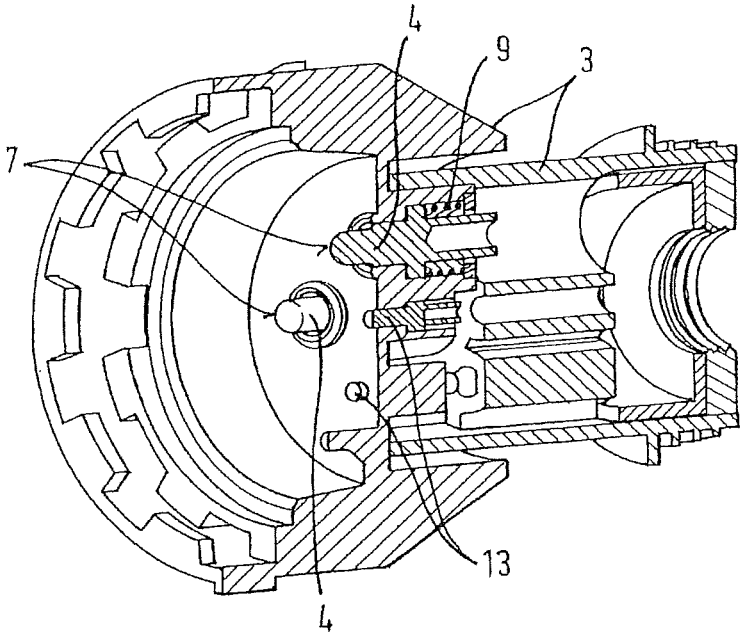
FIG. 7 shows a perspective view in longitudinal section of a first plug connector of the plug connection according to FIG. 6.
Figure 8:
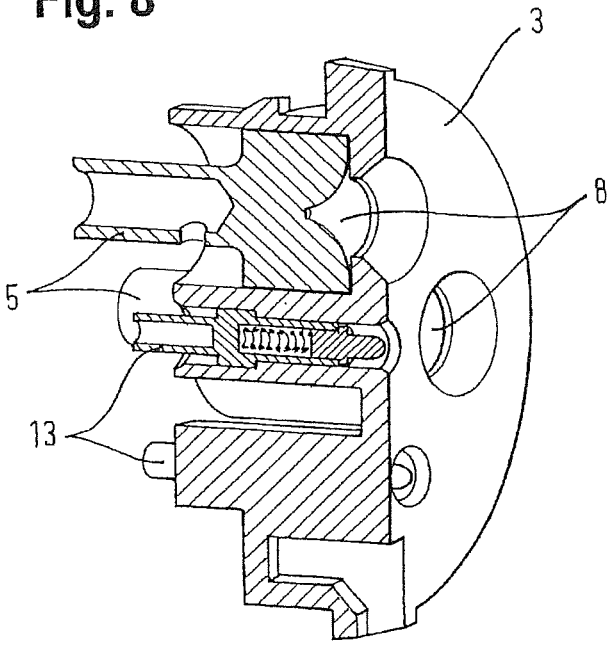
FIG. 8 shows a perspective view in longitudinal section of the second plug connector of the plug connection according to FIG. 6.

The second embodiment of a plug connection according to the invention shown in FIGS. 6 to 8 also comprises a first plug connector 1 and a second plug connector 2.

The main difference in comparison with the plug connection shown in FIGS. 1 to 5 is the provision of a plurality of contact elements. Specifically, three pairs of contact elements 4, 5 which make contact in accordance with the invention are provided. The individual contact elements 4, 5 are designed in the same way as in the first embodiments shown in FIGS. 1 to 5 and are integrated in the associated housing 3 in a substantially identical manner. However, in the case of the first plug connector 1 the helical springs 9 biasing the contact elements 4 are not supported at their rear ends against fixing sleeves but against an end face of a housing section of the multipart housing 3.

The contact elements 4, 5 can be provided in order to transmit high current in a high voltage circuit. For example, these can be integrated in the electric traction network of a (partially) electric motor vehicle or in a charging system for such a vehicle. According to the invention, "high voltage" is understood to mean an electric voltage of at least 30V AC and at least 60V DC. Accordingly, "low voltage" is understood to mean an electric voltage below 30 V or 60 V respectively.

The two plug connectors 1, 2 also include contact elements 13 with smaller dimensions which can be part of a safety circuit operated with low voltage which can serve as a so-called interlock for the high voltage circuit including the contact elements 4, 5.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connection comprising a first plug connector with a first contact part and a second plug connector with a second contact part, wherein, in the plugged-together state of the plug connection, the contact parts make contact with one another axially in a spring-biased manner, such that the first contact part has a three-dimensionally-curved end face and the second contact part has a depression in its end face which widens in a trumpet-like form in the direction of the plug-side end of the second contact part, so that an annular contact region between the contact parts is created.

2. The plug connection of claim 1, wherein the depression of the second contact part is conical in form.

3. The plug connection of claim 1, including a first housing accommodating the first contact part and/or a second housing accommodating the second contact part, wherein at least one of the contact parts is mounted in the associated housing such that it can be displaced axially in a spring-biased manner.

4. The plug connection of claim 3, including a helical spring surrounding the axially displaceable spring-biased contact part which is supported between a section of the contact part and a section of the housing.

5. The plug connection of claim 1, wherein the end face of the first contact part is partially spherical.

6. The plug connection of claim 5, wherein the depression of the second contact part is conical in form.

7. The plug connection of claim 6, including a first housing accommodating the first contact part and/or a second housing accommodating the second contact part, wherein at least one of the contact parts is mounted in the associated housing such that it can be displaced axially in a spring-biased manner.

* * * * *